US012158280B2

(12) United States Patent
Li et al.

(10) Patent No.: US 12,158,280 B2
(45) Date of Patent: Dec. 3, 2024

(54) CONTROL SYSTEM OF AIR CONDITIONER AND AIR-CONDITIONING DEVICE

(71) Applicants: SHANGHAI MEICON INTELLIGENT CONSTRUCTION CO., LTD., Shanghai (CN); GD MIDEA HEATING & VENTILATING EQUIPMENT CO., LTD., Foshan (CN)

(72) Inventors: Yuanyang Li, Shanghai (CN); Jie Yan, Shanghai (CN); Rui Liang, Shanghai (CN); Bin Luo, Shanghai (CN)

(73) Assignees: SHANGHAI MEICON INTELLIGENT CONSTRUCTION CO., LTD., Shanghai (CN); GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 345 days.

(21) Appl. No.: 17/603,324

(22) PCT Filed: Mar. 19, 2020

(86) PCT No.: PCT/CN2020/080253
§ 371 (c)(1),
(2) Date: Oct. 12, 2021

(87) PCT Pub. No.: WO2021/000606
PCT Pub. Date: Jan. 7, 2021

(65) Prior Publication Data

US 2022/0205667 A1 Jun. 30, 2022

(30) Foreign Application Priority Data

Jul. 1, 2019 (CN) ..... 201910585073.4
Jul. 1, 2019 (CN) ..... 201921023083.0

(51) Int. Cl.
*F24F 11/63* (2018.01)
*F24F 5/00* (2006.01)
(Continued)

(52) U.S. Cl.
CPC ..... *F24F 11/63* (2018.01); *F24F 5/0003* (2013.01); *F24F 11/54* (2018.01); *F24F 2110/10* (2018.01);
(Continued)

(58) Field of Classification Search
CPC ..... F24F 11/63; F24F 5/0003; F24F 11/54; F24F 2110/10; F24F 2110/20;
(Continued)

(56) References Cited

U.S. PATENT DOCUMENTS 9,999,160 B1 * 6/2018 Dariavach ..... H05K 7/20709
2017/0241658 A1 * 8/2017 Salsbury ..... F24F 11/83
(Continued)

FOREIGN PATENT DOCUMENTS

CN 101089503 A 12/2007
CN 102589097 A 7/2012
(Continued)

OTHER PUBLICATIONS

ISR for PCT application No. PCT/CN2020/080253.
First OA received in CN application 201910585073.4; mailed Jun. 5, 2024.

*Primary Examiner* — Marc E Norman
*Assistant Examiner* — Matthew John Moscola

(57) ABSTRACT

Provided in the present application are a control system of an air conditioner and an air-conditioning device. The control system of the air conditioner comprises: a main machine control assembly receiving a feedback parameter of a main machine, to adjust, according to the feedback parameter, a water discharge temperature of the main machine; a water
(Continued)

pump control assembly, and the water pump control assembly is in communication with the main machine control assembly, to adjust, according to a feedback parameter of the water pump, an operating parameter of a water pump; a cooling tower control assembly, and the cooling tower control assembly is connected to the water pump control assembly, to adjust, according to an environment parameter and a target water discharge temperature, the current water discharge temperature of a cooling tower; and a tail end control assembly.

5 Claims, 2 Drawing Sheets

(51) Int. Cl.

| | |
|---|---|
| ***F24F 11/54*** | (2018.01) |
| ***F24F 110/10*** | (2018.01) |
| ***F24F 110/20*** | (2018.01) |
| ***F24F 140/50*** | (2018.01) |

(52) U.S. Cl.
CPC ..... *F24F 2110/20* (2018.01); *F24F 2140/50* (2018.01)

(58) Field of Classification Search
CPC ..... F24F 2140/50; F24F 11/83; F24F 11/30; F24F 11/89
See application file for complete search history.

(56) References Cited

U.S. PATENT DOCUMENTS

| | | | | |
|---|---|---|---|---|
| 2018/0267515 | A1* | 9/2018 | House | F24F 11/63 |
| 2021/0262686 | A1* | 8/2021 | Kuang | F24F 5/0003 |

FOREIGN PATENT DOCUMENTS

| | | | |
|---|---|---|---|
| CN | 105020845 | A | 11/2015 |
| CN | 105444356 | A | 3/2016 |
| CN | 110285554 | A | 9/2019 |
| CN | 210241918 | U | 4/2020 |
| JP | 2003222448 | A | 8/2003 |

* cited by examiner

CONTROL SYSTEM OF AIR CONDITIONER AND AIR-CONDITIONING DEVICE

CROSS-REFERENCES TO RELATED APPLICATIONS

The present disclosure is a national phase application of International Application No. PCT/CN2020/080253, filed on Mar. 19, 2020, which claims priority to Chinese Patent Application No. 201921023083.0, filed on Jul. 1, 2019, and Chinese Patent Application No. 201910585073.4, filed on Jul. 1, 2019, the entireties of which are herein incorporated by reference.

FIELD

The present application relates to the field of air-conditioning devices, and particularly to a control system of an air conditioner and an air-conditioning device.

BACKGROUND

In a conventional art, each device in a conventional distributed central air-conditioning control system is controlled by a master controller. There are the following defects: when a certain device fails, an execution logic in the master controller is very likely to interrupt, spreading the influence of the failure to other parts to make the failure difficult to locate and check. In addition, due to the coupling of each functional module in a control logic, the whole system cannot operate normally after the device fails.

SUMMARY

The present application solves at least one of the foregoing problems.

To this end, an objective of the present application is to disclose a control system of an air conditioner. The control system may improve flexibility of system control and reduce energy consumption of the system. In addition, the control system is easily maintained, whereby construction and debugging periods can be effectively shortened, and labor costs can be reduced.

A second objective of the present application is to disclose an air-conditioning device.

In order to achieve the above objective, a first aspect of the present application discloses a control system of an air conditioner, which includes: a main machine control assembly receiving a feedback parameter of a main machine to adjust a water discharge temperature of the main machine according to the feedback parameter; a water pump control assembly, wherein the water pump control assembly is in communication with the main machine control assembly to adjust an operating parameter of a water pump according to a feedback parameter of the water pump; a cooling tower control assembly, wherein the cooling tower control assembly is connected to the water pump control assembly to adjust a current water discharge temperature of a cooling tower according to an environment parameter and a target water discharge temperature; and a tail end control assembly, wherein the tail end control assembly is connected to the water pump control assembly to adjust an operating state of a tail end according to user requirements.

According to the control system of the air conditioner in the present application, the control system is divided into the main machine control assembly, the water pump control assembly, the cooling tower control assembly, and the tail end control assembly, the assemblies do not interfere with one another and are independently controlled, and in addition, each assembly may cooperatively work to implement the operation of the whole system. Therefore, flexibility of system control can be improved, and energy consumption of the system can be reduced. In addition, the control system is easily maintained, whereby construction and debugging periods can be effectively shortened, and labor costs can be reduced.

In some examples, the main machine control assembly includes: a communication assembly, wherein the communication assembly is connected to the main machine to receive the feedback parameter of the main machine, the feedback parameter including a load of the main machine; and a main machine processor, wherein the main machine processor is connected to the communication assembly to adjust the water discharge temperature of the main machine according to the load of the main machine.

In some examples, the water pump control assembly includes: a front-end water pump control assembly adjusting a water amount provided for the main machine according to a feedback parameter of a front-end water pump; and a back-end water pump control assembly adjusting a water amount provided for the tail end according to a feedback parameter of a back-end water pump.

In some examples, the front-end water pump control assembly adjusts power of the front-end water pump to change the water amount provided for the main machine. The back-end water pump control assembly adjusts power of the back-end water pump to change the water amount provided for the tail end.

In some examples, the cooling tower control assembly includes: a detection assembly detecting the environment parameter and the current water discharge temperature; and a cooling tower processor, connected to the detection assembly to adjust the current water discharge temperature of the cooling tower according to the environment parameter and a temperature difference between the target water discharge temperature and the current water discharge temperature.

In some examples, the environment parameter includes an environment temperature and an environment humidity.

In some examples, the tail end control assembly includes: a user instruction receiving assembly receiving a user instruction; and a tail end processor, connected to the user instruction receiving assembly to adjust the operating state of the tail end according to the user instruction.

In some examples, the tail end processor adjusts a supply air temperature, a water vale opening and a fan frequency of the tail end according to the user instruction.

A second aspect of the present application discloses an air-conditioning device, which includes the control system of the air conditioner in the embodiment of the first aspect. According to the air-conditioning device of the present application, the control system is divided into the main machine control assembly, the water pump control assembly, the cooling tower control assembly, and the tail end control assembly, the assemblies do not interfere with one another and are independently controlled, and in addition, each assembly may cooperatively work to implement the operation of the whole system. Therefore, flexibility of system control can be improved, and energy consumption of the system can be reduced. In addition, the control system is easily maintained, whereby construction and debugging periods can be effectively shortened, and labor costs can be reduced.

In some examples, the air-conditioning device is an air conditioner.

Additional aspects and advantages of the present application will be partially presented in the following descriptions and partially become apparent from the following descriptions or get understood by implementing the present application.

BRIEF DESCRIPTION OF THE DRAWINGS

The abovementioned and/or additional aspects and advantages of the present application will become apparent and easy to understand from the descriptions made to embodiments below in combination with the drawings.

DETAILED DESCRIPTION OF THE DISCLOSURE

Figure 1:
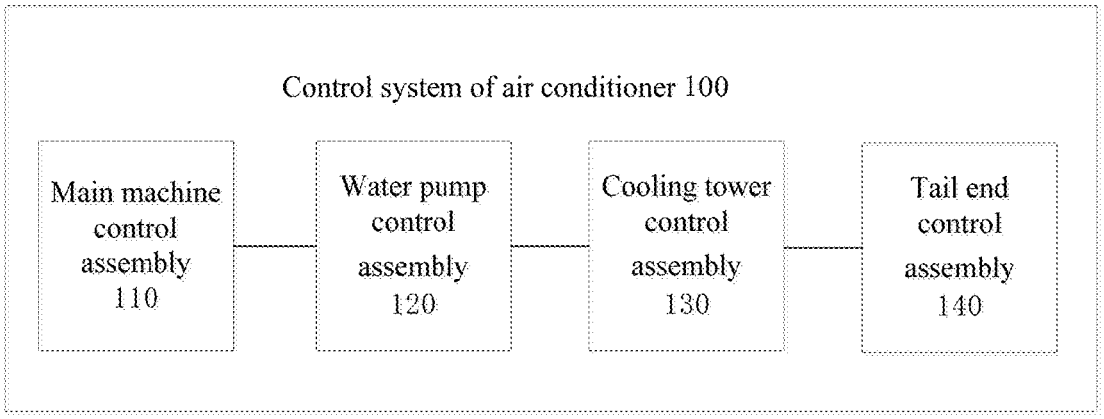
FIG. 1 is a structure block diagram of a control system of an air conditioner according to an embodiment of the present application.

The embodiments of the present application will be described below in detail.

Examples of the embodiments are illustrated in the drawings throughout which the same or similar reference signs represent the same or similar elements or elements with the same or similar functions. The embodiments described below with reference to the drawings are only examples for explaining the present application and should not be understood as limits to the present application.

In the descriptions of the present application, it is to be understood that orientation or position relationships indicated by terms "center", "longitudinal", "transverse", "upper", "lower", "front", "back", "left", "right", "vertical", "horizontal", "top", "bottom", "inner", "outer", and the like are orientation or position relationships shown in the drawings, are adopted not to indicate or imply that indicated apparatuses or elements must be in specific orientations or structured and operated in specific orientations but only to easily describe the present application and simplify descriptions, and thus should not be understood as limits to the present application. In addition, terms "first" and "second" are only for a purpose of description and should not be understood as indicating or imply relative importance.

A control system of an air conditioner and an air-conditioning device according to the embodiments of the present application are described in combination with the drawings.

FIG. 1 is a structure block diagram of a control system of an air conditioner according to an embodiment of the present application. As shown in FIG. 1, a control system 100 of an air conditioner according to an embodiment of the present application includes a main machine control assembly 110, a water pump control assembly 120, a cooling tower control assembly 130, and a tail end control assembly 140.

The main machine control assembly 110 is configured to receive a feedback parameter of a main machine to adjust a water discharge temperature of the main machine according to the feedback parameter. The water pump control assembly 120 is in communication with the main machine control assembly 110 to adjust an operating parameter of a water pump according to a feedback parameter of the water pump. The cooling tower control assembly 130 is connected to the water pump control assembly 120 to adjust a current water discharge temperature of a cooling tower according to an environment parameter and a target water discharge temperature. The tail end control assembly 140 is connected to the water pump control assembly 120 to adjust an operating state of a tail end according to user requirements.

Figure 2:
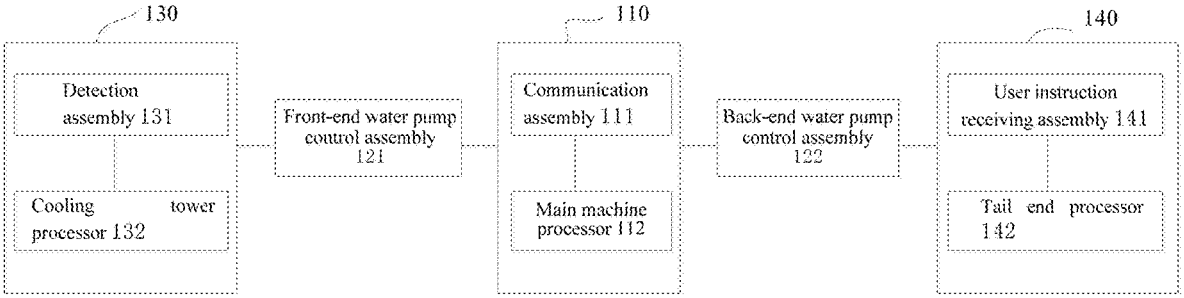
FIG. 2 is a composition block diagram of each control assembly according to an embodiment of the present application.

FIG. 2 is a composition block diagram of each control assembly of the control system of the air conditioner. The main machine control assembly 110 includes a communication assembly 111 and a main machine processor 112. The communication assembly 111 is connected to the main machine to receive the feedback parameter of the main machine, the feedback parameter including a load of the main machine. The main machine processor 112 is connected to the communication assembly 111 to adjust the water discharge temperature of the main machine according to the load of the main machine. In addition, there may be multiple main machines. The main machine includes a chilled water and cooling water valve. Adjustment in the module and loading and unloading may be performed according to a temperature and current load rate fed back by the main machine. The main machine control assembly 110 may intelligently adjust the water discharge temperature of the main machine with the changing of the load.

The water pump control assembly 120 includes a front-end water pump control assembly 121 and a back-end water pump control assembly 122. The front-end water pump control assembly 121 may adjust a water amount provided for the main machine according to a feedback parameter of a front-end water pump. The back-end water pump control assembly 122 may adjust a water amount provided for the tail end according to a feedback parameter of a back-end water pump. The front-end water pump control assembly 121 may adjust power of the front-end water pump to change the water amount provided for the main machine. The back-end water pump control assembly 122 may adjust power of the back-end water pump to change the water amount provided for the tail end. For the water pump, a water pump unit consisting of multiple water pumps corresponds to a total supply water temperature, a total return water temperature, water pump unit inlet pressure, total pressure of water returning from the main machine to the water pump group and total water pump unit outlet pressure. Adjustment in the module and loading and unloading may be performed according to temperature and pressure signals distributed in a water pump pipe network. The water pump control assembly 120 may ensure a minimum flow of the main machine and perform matching in real time as required.

The cooling tower control assembly 130 includes a detection assembly 131 and a cooling tower processor 132. The detection assembly 131 is configured to detect the environment parameter and the current water discharge temperature. The environment parameter includes an environment temperature and an environment humidity. The cooling tower processor 132 is connected to the detection assembly 131 to adjust the current water discharge temperature of the cooling tower according to the environment parameter and a temperature difference between the target water discharge temperature and the current water discharge temperature. Through the cooling tower control assembly 130, it may be ensured that the cooling tower may provide an optimal water discharge temperature state under a heat dissipation limit.

The tail end control assembly 140 includes a user instruction receiving assembly 141 and a tail end processor 142.

The user instruction receiving assembly 141 is configured to receive a user instruction. The tail processor 142 is connected to the user instruction receiving assembly 141 to adjust the operating state of the tail end according to the user instruction. The operating state, adjusted by the tail end processor 142 according to the user instruction, of the tail end includes a supply air temperature, water valve opening and fan frequency of the tail end. The tail end control assembly 140 may match a cooling capacity and a requirement to maximally reduce the energy consumption of a fan on the premise of ensuring the comfort level of the tail end.

Figure 3:
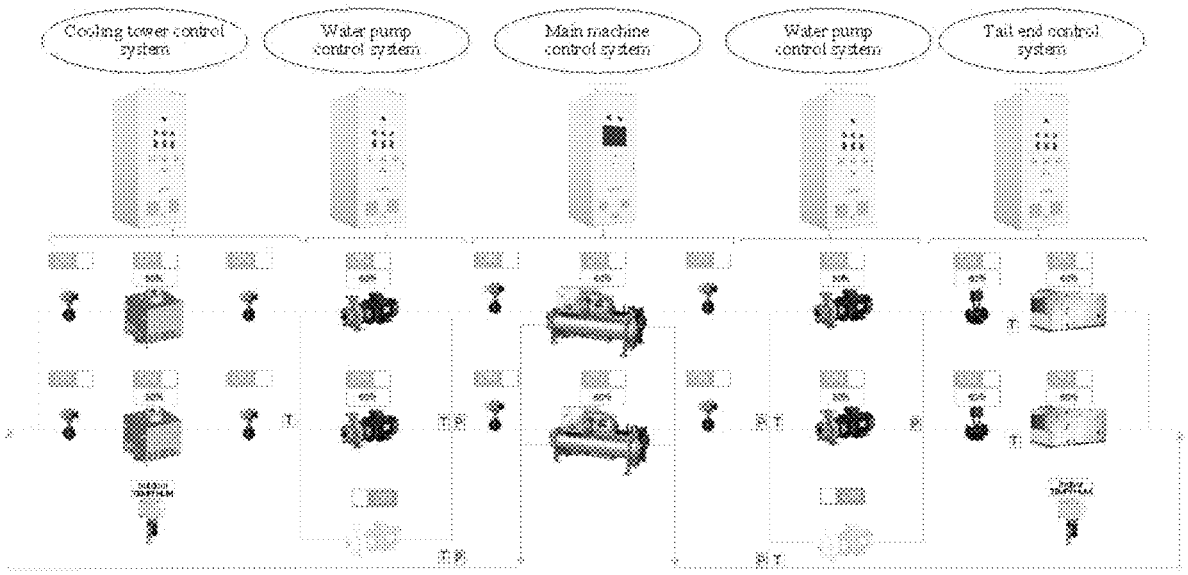
FIG. 3 is a schematic diagram of a control system of an air conditioner according to an embodiment of the present application.
Figure 4:
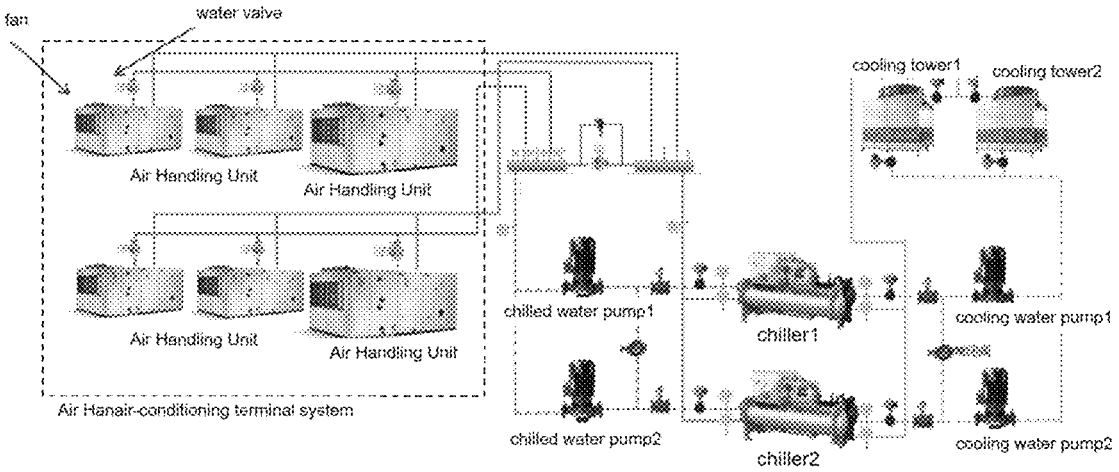
FIG. 4 is a schematic diagram of a control system of an air conditioner according to an embodiment of the present application.

FIG. 3 is a schematic diagram of the control system of the air conditioner. It can be seen that the control system of the air conditioner consists of a cooling tower control system, a water pump control system, a main machine control system, and a tail end control system. The control system of the air conditioner in the present application is applicable to computer room systems in different forms according to different types and numbers of system combinations, and is also applicable to a high/low voltage integrated solution and high and low voltage solutions. In addition, the control system may interact in real time with a cloud, and parameter optimization setting and energy efficiency detection and analysis capable of achieving a better overall operating effect may be implemented at the cloud. If a certain device fails, the failing device may be forbidden to be turned on by intelligent identification, and another device operates instead.

According to the control system of the air conditioner according to the embodiment of the present application, the control system is divided into the main machine control assembly, the water pump control assembly, the cooling tower control assembly, and the tail end control assembly, the assemblies do not interfere with one another and are independently controlled, and in addition, each assembly may cooperatively work to implement the operation of the whole system. Therefore, flexibility of system control can be improved, and energy consumption of the system can be reduced. In addition, the control system is easily maintained, whereby construction and debugging periods can be effectively shortened, and labor costs can be reduced.

Further, an embodiment of the present application discloses an air-conditioning device, which includes the control system of the air conditioner as described in any abovementioned embodiment. According to the air-conditioning device according to the embodiment of the present application, the control system is divided into the main machine control assembly, the water pump control assembly, the cooling tower control assembly, and the tail end control assembly, the assemblies do not interfere with one another and are independently controlled, and in addition, each assembly may cooperatively work to implement the operation of the whole system. Therefore, flexibility of system control can be improved, and energy consumption of the system can be reduced. In addition, the control system is easily maintained, whereby construction and debugging periods can be effectively shortened, and labor costs can be reduced.

In a specific example, the air-conditioning device is an air conditioner.

What is claimed is:

1. A control system of a water-cooled central air conditioner, the system comprising:

a chiller controller receiving a feedback parameter of a chiller to adjust a water discharge temperature of the chiller according to the feedback parameter;

a water pump controller, wherein the water pump controller is in communication with the chiller controller to adjust an operating parameter of a water pump according to a feedback parameter of the water pump;

a cooling tower controller, wherein the cooling tower controller is connected to the water pump controller to adjust a current water discharge temperature of a cooling tower according to an environment parameter and a target water discharge temperature; and an indoor air handling unit controller, wherein the indoor air handling unit controller is connected to the water pump controller to adjust an operating state of an indoor air handling unit according to user requirements;

wherein the water pump controller comprises:

a cooling water pump controller adjusting a water amount provided for the chiller according to a feedback parameter of a cooling water pump; and a chilled water pump controller adjusting a water amount provided for the indoor air handling unit according to a feedback parameter of a chilled water pump.

2. The control system of the air conditioner of claim 1, wherein the chiller controller comprises: a communicator, wherein the communicator is connected to the chiller to receive the feedback parameter of the chiller, the feedback parameter comprising a load of the chiller; and a chiller processor, wherein the chiller processor is connected to the communicator to adjust the water discharge temperature of the chiller according to the load of the chiller.

3. The control system of the air conditioner of claim 1, wherein the cooling water pump controller adjusts power of the cooling water pump to change the water amount provided for the chiller; and the chilled water pump controller adjusts power of the chilled water pump to change the water amount provided for the indoor air handling unit.

4. The control system of the air conditioner of claim 1, wherein the cooling tower controller comprises: a detector detecting the environment parameter and the current water discharge temperature; and a cooling tower processor, connected to the detector to adjust the current water discharge temperature of the cooling tower according to the environment parameter and a temperature difference between the target water discharge temperature and the current water discharge temperature.

5. An air-conditioning device, comprising:

a control system of a water-cooled central air conditioner, the system comprising:

a chiller controller receiving a feedback parameter of a chiller to adjust a water discharge temperature of the chiller according to the feedback parameter;

a water pump controller, wherein the water pump controller is in communication with the chiller controller to adjust an operating parameter of a water pump according to a feedback parameter of the water pump;

a cooling tower controller, wherein the cooling tower controller is connected to the water pump controller to adjust a current water discharge temperature of a cooling tower according to an environment parameter and a target water discharge temperature; and an indoor air handling unit controller, wherein the indoor air handling unit controller is connected to the water pump controller to adjust an operating state of an indoor air handling unit according to user requirements;

wherein the water pump controller comprises:

a cooling water pump controller adjusting a water amount provided for the chiller according to a feedback parameter of a cooling water pump; and a chilled water pump controller adjusting a water amount provided for the indoor air handling unit according to a feedback parameter of a chilled water pump.

* * * * *